US005796380A

United States Patent [19]

Kurematsu

[11] Patent Number: 5,796,380

[45] Date of Patent: Aug. 18, 1998

[54] LIQUID CRYSTAL APPARATUS AND METHOD OF DRIVING SAME

[75] Inventor: Katsumi Kurematsu, Kawasaki, Japan

[73] Assignee: Canon Kabushiki Kaisha, Tokyo, Japan

[21] Appl. No.: 203,484

[22] Filed: Feb. 28, 1994

Related U.S. Application Data

[63] Continuation of Ser. No. 795,804, Nov. 21, 1991.

[30] Foreign Application Priority Data

Nov. 21, 1990 [JP] Japan ..... 2-314242

[51] Int. Cl.[6] ..... G09G 3/18

[52] U.S. Cl. ..... 345/96; 345/209; 345/97

[58] Field of Search ..... 340/784, 805; 345/95, 94, 92, 96, 97, 87, 204, 208, 209, 210; 359/54, 55, 56, 86; 349/42

[56] References Cited

U.S. PATENT DOCUMENTS

| | | | |
|---|---|---|---|
| 4,840,462 | 6/1989 | Hartmann | 350/350 S |
| 5,011,269 | 4/1991 | Wakita et al. | 340/784 |
| 5,040,874 | 8/1991 | Fukuda | 340/784 |
| 5,041,821 | 8/1991 | Onitsuka et al. | 340/784 |
| 5,136,282 | 8/1992 | Inaba et al. | 340/784 |

FOREIGN PATENT DOCUMENTS 0316774 5/1989 European Pat. Off. .

*Primary Examiner*—Lun-Yi Lao

*Attorney, Agent, or Firm*—Fitzpatrick, Cella, Harper & Scinto

[57] ABSTRACT

A liquid crystal apparatus includes a liquid crystal panel in which pixels are arranged along a plurality of rows and columns and a thin-film transistor is connected to each pixel. During a first field scanning period, a reset pulse of a single first polarity is supplied to the pixels to non-selectively erase the pixels along odd rows, and a write pulse of a polarity opposite to that of the reset pulse is supplied selectively to the pixels for writing on the pixels along even rows, the pixels supplied with the reset pulse being maintained at a voltage based on the reset pulse throughout the first field scanning period. During a second field scanning period subsequent to the first field scanning period, the write pulse is supplied selectively to the pixels for writing on the pixels along the odd rows, and the reset pulse is supplied to the pixels for non-selectively erasing the pixels along the even rows. The pixels supplied with the reset pulse are maintained at a voltage based on the reset pulse throughout the second field scanning period. A period of time from application of the reset pulse to a pixel to application of the write pulse to the same pixel is equal to a period of time from application of the write pulse to a pixel to application of the reset pulse to the same pixel.

4 Claims, 6 Drawing Sheets

LIQUID CRYSTAL APPARATUS AND METHOD OF DRIVING SAME

This application is a continuation of application Ser. No. 07/795,804 filed Nov. 21, 1991, now abandoned.

BACKGROUND OF THE INVENTION

1. Field of the Invention

The present invention relates to a display apparatus using a ferroelectric liquid crystal, a liquid crystal apparatus such as a shutter array, and a method of driving the same.

2. Related Background Art

In a conventional method of driving a liquid crystal panel, as described in U.S. Pat. No. 4,840,462 (Philips), a reset signal and a write signal are time-divisionally inserted in a horizontal sync period. FIG. 3 shows a drive system for realizing this conventional drive method, and FIGS. 4A and 4B show timings of signals in the drive system shown in FIG. 3. The drive system in FIG. 3 includes an active matrix type ferroelectric liquid crystal panel (to be referred to as an FLC panel hereinafter) 1, an X driver 2, a Y driver 3, a timing controller 4, a reset/write changeover circuit 5, a gate line 6, a signal line 7, an FLC pixel 8, and a TFT (Thin Film Transistor) 9. The drive system in FIG. 3 performs resetting in the first half of the horizontal sync period and write access in the second half of the horizontal sync period. The application period of a reset signal 11 for each pixel 8 is shifted from the application period of a write signal 10 by a few horizontal periods (four periods in the example of FIGS. 4A and 4B). A time interval of the several horizontal periods in which the pixel 8 is kept open during application of the reset signal 11 until the write signal 10 is applied is set so that a reset voltage 12 is kept applied to the ferroelectric liquid crystal (FLC) in the pixel 8. A time interval (the pixel 8 is kept in the open state) corresponding to almost the vertical period until the next reset signal 11 is applied is so set that a write voltage 13 is kept applied to the FLC in the pixel 8. Therefore, the pixel maintains a display state for a period corresponding to the write signal 10 except for the several horizontal periods from resetting to write access.

In the conventional example, since the application period of the write voltage (positive) is much longer than the application period of the reset voltage (negative), the voltage applied to the FLC pixel 8 is concentrated on the positive side on the average over time. For this reason, as shown in FIG. 5, impurity ions 14 present in an FLC layer 16 in the FLC pixel 8 are shifted and stored on upper and lower electrodes 15 and 17. The behavior (particularly, a write operation) of the FLC is undesirably interfered by an internal electric field generated by the stored ions.

SUMMARY OF THE INVENTION

The present invention has been made in consideration of the conventional problems described above, and has as its object to provide a method of appropriately driving an FLC panel to eliminate interference of impurity ions with a write operation when the FLC panel is driven in an interlace mode.

The present invention is characterized in that a nondisplay field period is used as a resetting period under the assumption that the FLC panel is driven in the interlace mode.

The present invention is characterized by a liquid crystal apparatus comprising:

a. a liquid crystal cell having a matrix electrode forming pixels at intersections between scanning electrodes and signal electrodes, and a ferroelectric liquid crystal interposed between the scanning electrodes and the signal electrodes; and b. means for alternately operating first and second steps, the first step being operated such that a voltage signal for aligning the ferroelectric liquid crystal in one alignment state is simultaneously applied to pixels on scanning electrodes corresponding to interlace scanning of the scanning electrodes, the scanning electrodes are sequentially scanned, and a voltage signal for aligning the ferroelectric liquid crystal in the other alignment state is selectively applied to pixels on the scanned scanning electrodes, and the second step being operated such that the voltage signal for aligning the ferroelectric liquid crystal in one alignment state is simultaneously applied to pixels on scanning electrodes except for the scanning electrodes of the first step, and the voltage signal for aligning the ferroelectric liquid crystal in the other alignment state is selectively applied to the pixels on the scanning electrodes.

DETAILED DESCRIPTION OF THE PREFERRED EMBODIMENT

According to the present invention, when an FLC panel is to be driven in an interlace mode, a nondisplay field period is used as a resetting period, and impurity ions stored on upper and lower electrodes of each FLC pixel can also be reset. For this reason, an interference of the impurity ions with a write operation can be eliminated, and the FLC panel can be appropriately driven.

Figure 1:
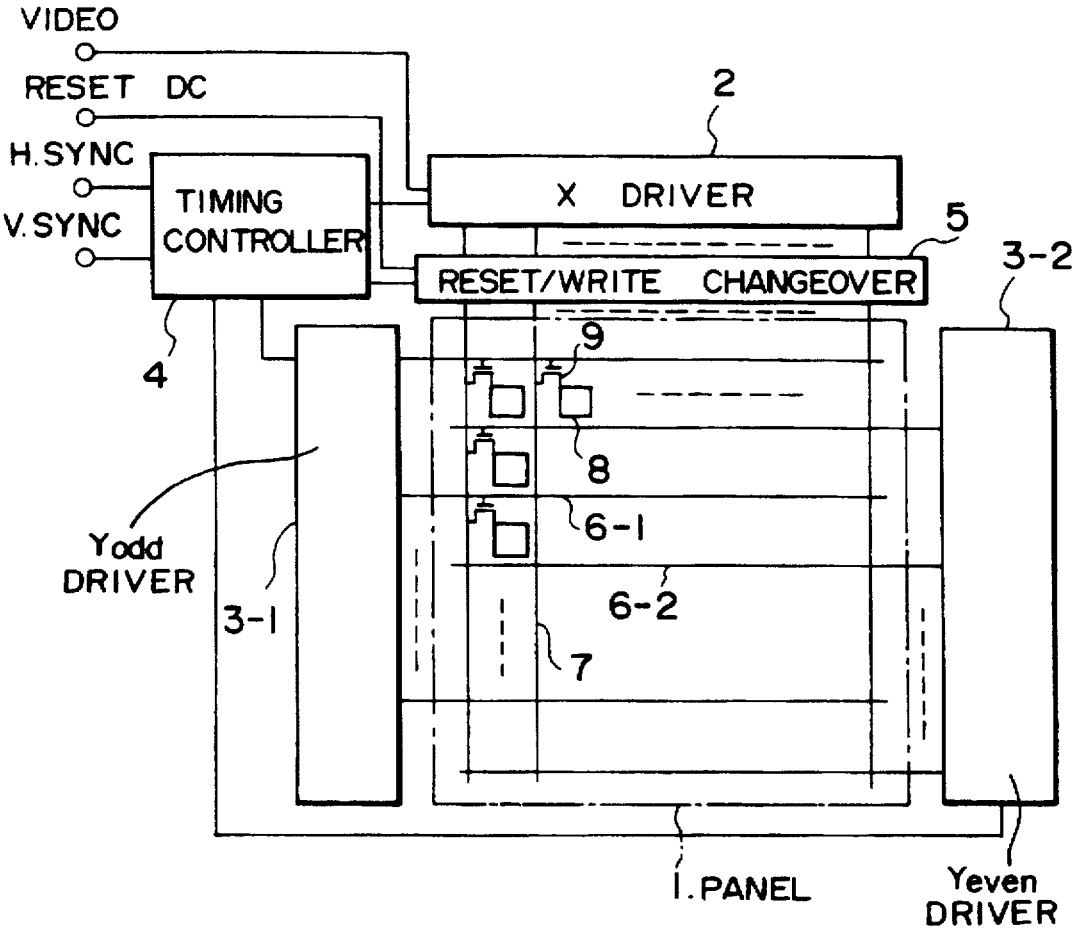
FIG. 1 is a block diagram of an FLC panel drive system according to an embodiment of the present invention.
Figure 2A:
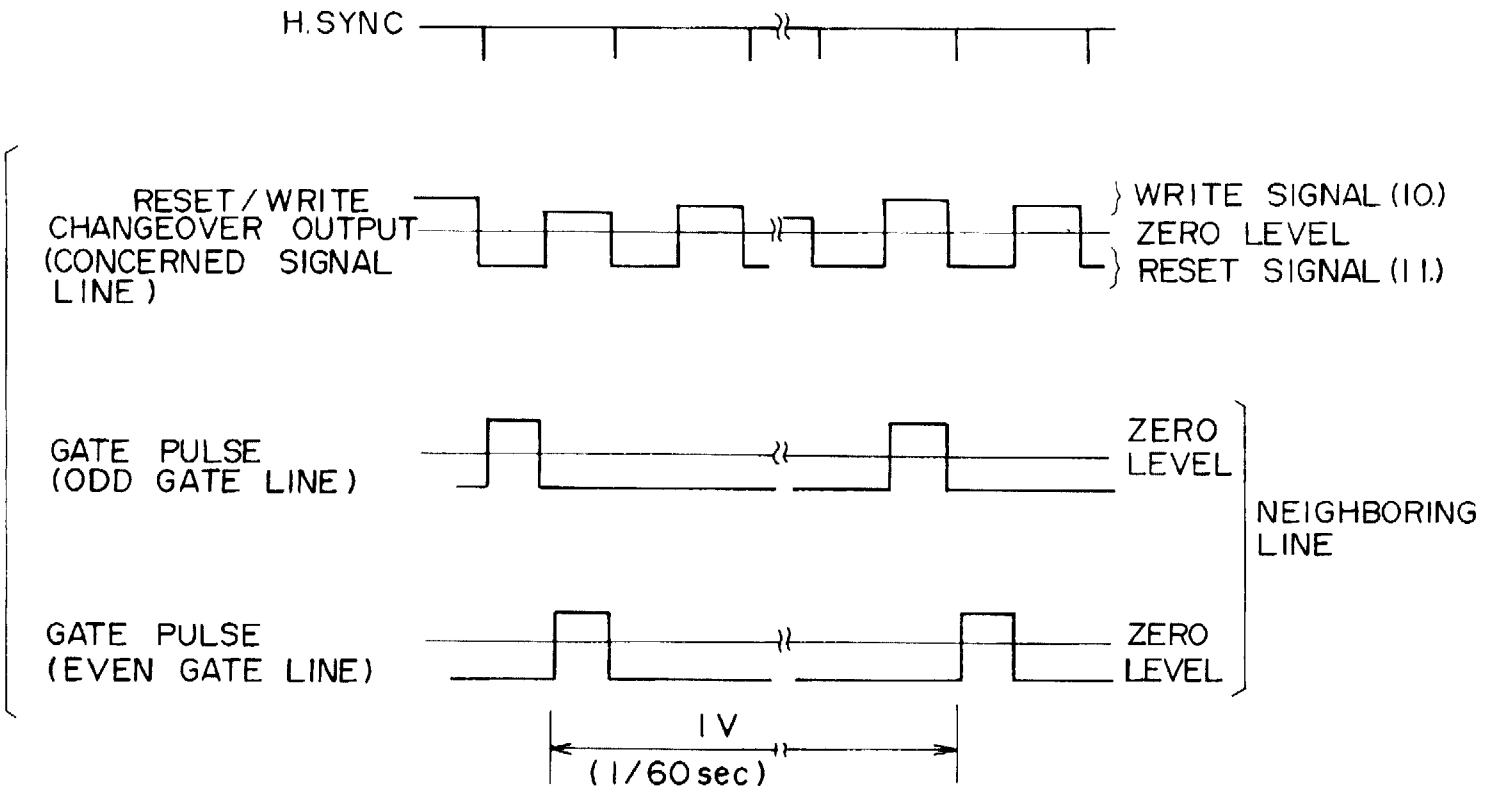
FIGS. 2A and 2B are timing charts of signals in the drive system in FIG. 1.
Figure 2B:
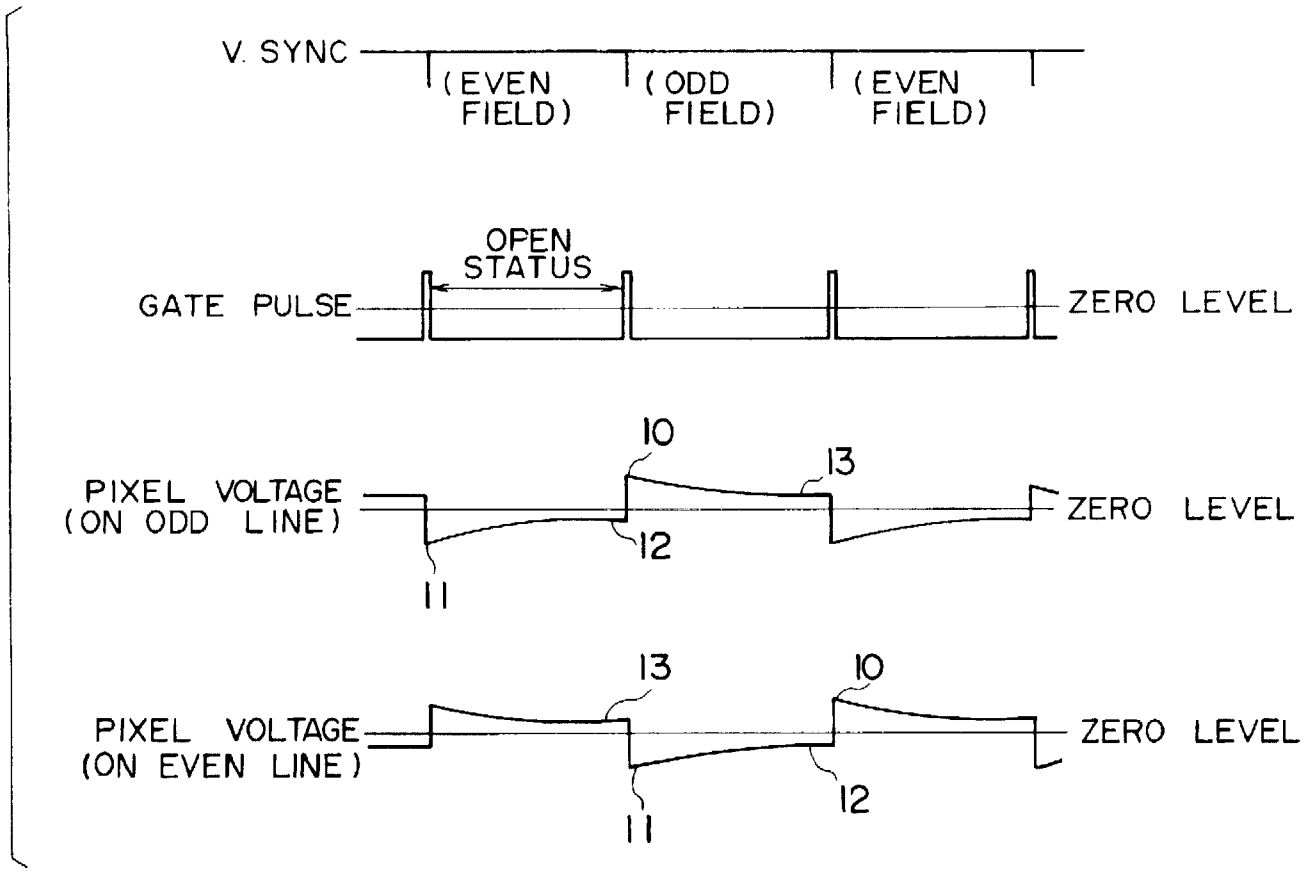
Figure 3:
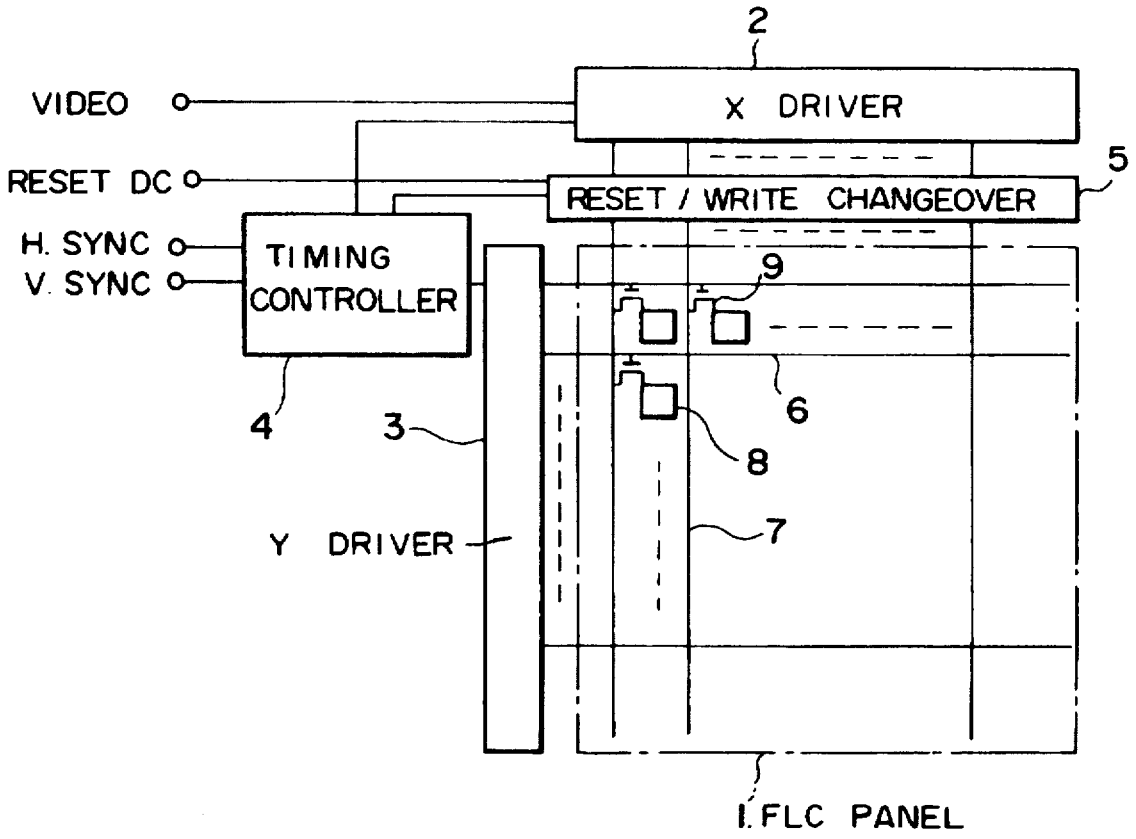
FIG. 3 (PRIOR ART)
FIG. 3 is a block diagram of a conventional FLC panel drive system.
Figure 4A:
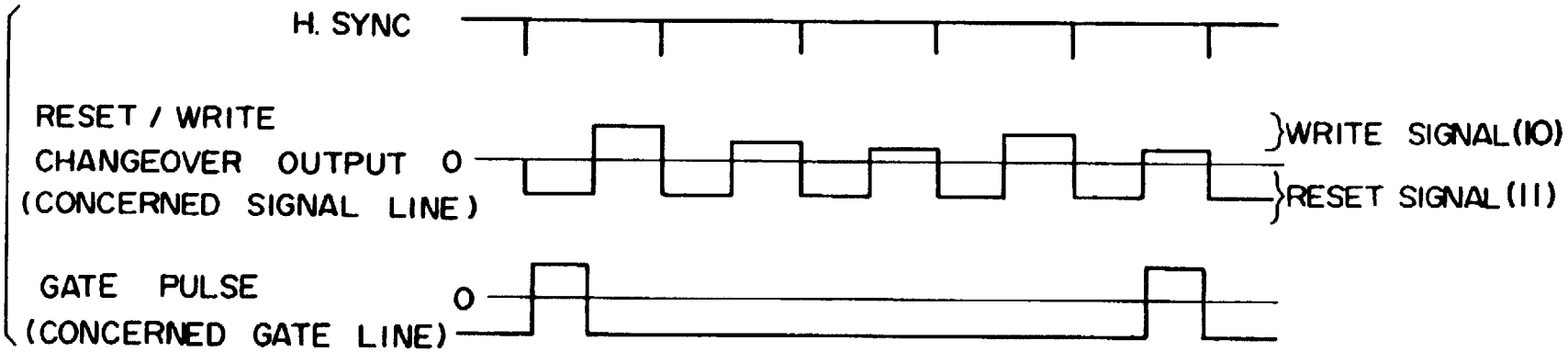
FIG. 4A (PRIOR ART)
FIGS. 4A and 4B are timing charts of the drive system in FIG. 3.
Figure 4B:
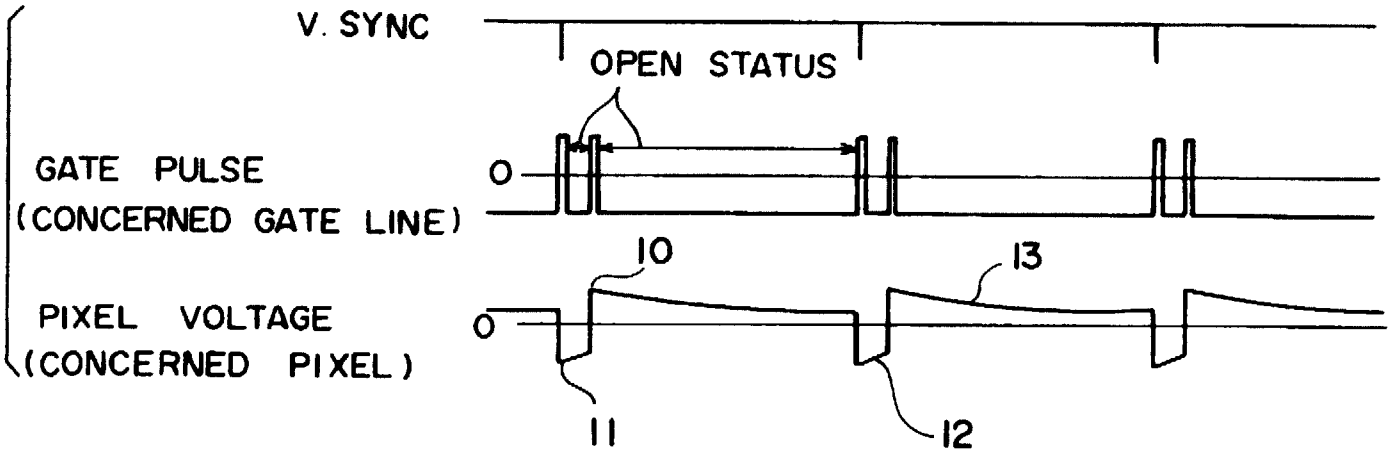
FIG. 4B (PRIOR ART)
Figure 5:
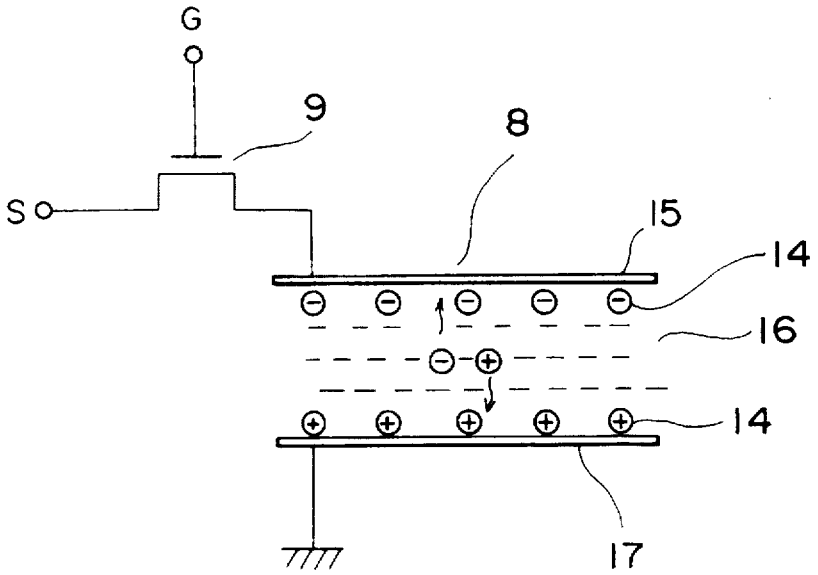
FIG. 5 is a view showing a section of an FLC pixel.

FIG. 1 is a block diagram of an FLC panel drive system according to an embodiment of the present invention, and FIGS. 2A and 2B are timing charts thereof. In the drive system shown in FIG. 1, the Y driver 3 in FIG. 3 is divided into a Yodd driver 3-1 and a Yeven driver 3-2. The FLC pixels constituting odd fields and the FLC pixels constituting even fields are independently driven. More specifically, in the drive system of FIG. 1, pixels 8 in the FLC panel 1 are interlaced by a TFT 9, an X driver 2, the Yodd driver 3-1, and the Yeven driver 3-2 in accordance with an active matrix scheme. The Yodd driver 3-1 drives gates of odd gate lines 6-1, and the Yeven driver 3-2 drives gates of even gate lines 6-2. A negative reset signal and a positive write signal are alternately applied every ½ horizontal period from a reset/write changeover circuit 5 to signal lines 7 (FIGS. 2A and 2B). Each write signal is a write signal obtained by holding a video signal sampled at a timing corresponding to each pixel by an amount of one horizontal line.

In an odd field period of the video signal, as shown in FIG. 2A, gate pulse application of the Yodd driver 3-1 is shifted from that of the Yeven driver 3-2 by a ½ horizontal period. A write signal 10 is applied to pixels on the odd gate lines 6-1, and the reset signal 11 is applied to the pixels on the even gate lines 6-2. A write voltage 13 is applied to the pixels on the odd gate line 6-1 during the field period, thereby continuously performing a display. A reset voltage 12 is applied to the pixels on the even gate line 6-2, thereby performing a resetting operation (FIG. 2B). During the even field period of the video signal, signals opposite to those in the odd field period are applied to the pixels on the gate lines. A reset voltage is kept applied to the pixels on the odd gate lines 6-1 to perform a resetting operation. A write voltage is kept applied to the pixels on the even gate lines 6-2 to perform a display (FIG. 2B). The positive and negative voltages applied to the FLC pixels cancel each other on the average over time, or the polarity of the total voltage is slightly shifted to the negative side (since the absolute value of the reset voltage is preferably set to be almost equal to the maximum value of the write voltage). The impurity ions are attracted to the side opposite to the write interference described above. The FLC and the impurity ions are reset to appropriately perform the next write operation. An appropriate display corresponding to the write voltage can be performed.

According to the present invention, as has been described above, when an FLC panel is to be driven in an interlace mode such as NTSC•HD, a nondisplay field period is used as a resetting period, thereby assuring a sufficiently long reset period. The impurity ions in the FLC layer can also be reset, thereby performing an excellent write operation.

What is claimed is:

1. A liquid crystal apparatus comprising:

a liquid crystal panel in which pixels, each comprising a pair of opposite electrodes and a ferroelectric liquid crystal, including an impurity ion which migrates within the liquid crystal according to an applied voltage, provided between said opposite electrodes, are arranged along a plurality of rows and columns and a thin-film transistor is connected to each pixel, wherein, during a first field scanning period, a reset pulse of a single first polarity is supplied to the pixels to non-selectively erase the pixels along odd rows, and a write pulse of a polarity opposite to that of the reset pulse is supplied selectively to the pixels for writing on the pixels along even rows, the pixels supplied with the reset pulse being maintained at a voltage based on the reset pulse throughout the first field scanning period; and during a second field scanning period subsequent to the first field scanning period, the write pulse is supplied selectively to the pixels for writing on the pixels along the odd rows, and the reset pulse is supplied to the pixels for non-selectively erasing the pixels along the even rows, the pixels supplied with the reset pulse being maintained at a voltage based on the reset pulse throughout the second field scanning period, wherein a period of time from application of the reset pulse to a pixel to application of the write pulse to the same pixel is equal to a period of time from application of the write pulse to a pixel to application of the reset pulse to the same pixel.

2. An apparatus according to claim 1, wherein the first field scanning period is an even field scanning period, and the second field scanning period is an odd field scanning period.

3. A method for driving a liquid crystal panel comprising a liquid crystal including an impurity ion that migrates within the liquid crystal according to an applied voltage, and scanning electrodes and signal electrodes crossing each other, said method comprising:

a first step of executing interlace scanning to scan selected ones of the scanning electrodes by applying a writing voltage to pixels on the selected scanning electrodes to perform writing of the selected scanning electrodes during a single vertical scanning period; and during the single vertical scanning period, a second step of executing a scanning of scanning electrodes that were not selected at said first step by applying a reset voltage to pixels on the non-selected scanning electrodes to perform a reset of the pixels on the non-selected scanning electrodes not selected during said first step, the pixels supplied with the reset voltage signal maintaining a voltage based on the reset voltage signal throughout the single vertical scanning period, wherein both the writing and reset voltages are single polarity voltages and the writing and reset voltages are of mutually opposite polarity, and wherein a period of time from application of the reset pulse to a pixel to application of the write pulse to the same pixel is equal to a period of time from application of the write pulse to a pixel to application of the reset pulse to the same pixel.

4. A method according to claim 3, wherein the liquid crystal is a ferroelectric liquid crystal.

* * * * *